US012773087B2

(12) United States Patent
Unterberger et al.

(10) Patent No.: US 12,773,087 B2
(45) Date of Patent: Oct. 27, 2026

(54) HOME APPLIANCE

(71) Applicant: Bleckmann GmbH & Co. KG, Lamprechtshausen (AT)

(72) Inventors: Hubert Unterberger, Bürmoos (AT); Clemens Haas, St. Gilgen (AT); Aljbert Ljatifi, Salzburg (AT)

(73) Assignee: Bleckmann GmbH & Co. KG, Lamprechtshausen (AT)

( * ) Notice: Subject to any disclaimer, the term of this patent is extended or adjusted under 35 U.S.C. 154(b) by 93 days.

(21) Appl. No.: 18/512,336

(22) Filed: Nov. 17, 2023

(65) Prior Publication Data

US 2024/0164617 A1 May 23, 2024

(30) Foreign Application Priority Data

Nov. 18, 2022 (EP) ..... 22208408

(51) Int. Cl.
*A47L 15/00* (2006.01)
*A47L 15/42* (2006.01)
(Continued)

(52) U.S. Cl.
CPC ..... *A47L 15/0047* (2013.01); *A47L 15/0021* (2013.01); *A47L 15/4225* (2013.01);
(Continued)

(58) Field of Classification Search
CPC ..... A47L 15/0021; A47L 15/0047; A47L 15/4214; A47L 15/4225; A47L 15/4291;
(Continued)

(56) References Cited

U.S. PATENT DOCUMENTS 5,660,193 A * 8/1997 Archer ..... A47L 15/4285 134/108
2021/0244255 A1* 8/2021 Haegermarck ..... A47L 15/4291

FOREIGN PATENT DOCUMENTS

CH 715427 A1 4/2020
DE 102013002116 A1 8/2014
(Continued)

OTHER PUBLICATIONS

Machine translation of DE102016109186A1 (Year: 2016).*
EPO; Application No. 22208408. 9; Extended European Search Report dated May 19, 2023.

*Primary Examiner* — Douglas Lee
(74) *Attorney, Agent, or Firm* — Fitch, Even, Tabin & Flannery LLP

(57) ABSTRACT

The present invention relates to a home appliance, and a method for controlling said home appliance. The home appliance comprises a water supply unit including a water supply port for supplying water to the home appliance, a water reservoir for storing water supplied to the home appliance by the water supply unit, a treatment space for treating objects in the home appliance, at least one pump unit for circulating water inside the treatment space and for discharging water from the treatment space and a control unit for controlling the operation of the home appliance. A heat exchanger is arranged between the water supply unit and the water reservoir, for exchanging heat between the water supplied to the reservoir and the water discharged from the treatment space by the at least one pump unit.

12 Claims, 5 Drawing Sheets

(51) Int. Cl.
*A47L 15/46* (2006.01)
*F28D 21/00* (2006.01)

(52) U.S. Cl.
CPC ..... *A47L 15/4291* (2013.01); *A47L 15/46* (2013.01); *F28D 21/0012* (2013.01); *A47L 2401/14* (2013.01); *A47L 2401/20* (2013.01); *A47L 2501/01* (2013.01); *A47L 2501/05* (2013.01)

(58) Field of Classification Search
CPC .. A47L 15/46; A47L 2401/06; A47L 2401/14; A47L 2401/20; A47L 2501/01; A47L 2501/05; D06F 2103/14; D06F 2105/02; D06F 2105/06; D06F 33/46; D06F 39/083; D06F 39/088; D06F 39/30; F28D 21/0012
See application file for complete search history.

(56) References Cited

FOREIGN PATENT DOCUMENTS

| | | | | | |
|---|---|---|---|---|---|
| DE | 102016109186 | A1 | * | 12/2016 | ..... A47L 15/4214 |
| EP | 3639722 | A1 | | 4/2020 | |
| WO | 2012089569 | A2 | | 7/2012 | |

* cited by examiner

HOME APPLIANCE

CROSS-REFERENCE TO RELATED APPLICATION

This patent application is based upon and claims the benefit of priority under 35 USC 119 of European Patent Application No. 22208408.9, filed on Nov. 18, 2022, the entire disclosure of which, including the specification, claims, drawings, and abstract, is incorporated herein by reference in its entirety.

FIELD

The present invention relates to a home appliance, in particular a dishwasher, a washing machine or the like, which comprises a water supply unit including a water supply port for supplying water, like fresh water, to the home appliance, a water reservoir for storing water to be supplied to the home appliance by the water supply unit, a treatment space for treating objects in the home appliance, like dishes or laundry, at least one pump unit for circulating water inside the treatment space and for discharging water from the treatment space, and a control unit for controlling the operation of the home appliance. The present invention further relates to a method for controlling a home appliance.

BACKGROUND

In a known home appliance, like a dishwasher or a washing machine, items to be cleaned are accommodated in a treatment space to which water and a respective cleaning agent are supplied. The water for treating said items, like fresh water provided by a public water supply, is provided in a water reservoir from which a respective amount is supplied in accordance with a selected cleaning program stored in a control unit of said home appliance. Fresh water usually has a temperature of about 10 to 15° C. Prior to supplying water to the treatment space, the water stored in the reservoir is usually warmed up by the ambient air to a temperature at least close to the temperature of the ambience. For further heating of the fresh water to be used in a cleaning process, additional heating devices, like a heat exchanger or an electric heating device, may be provided. Said additional heating device may be arranged inside the reservoir or inside the treatment space.

Usually, during a cleaning process, the process water can be replaced several times. At each of these exchanges, it is necessary to heat the fresh water that replaces the discharged process water or greywater. Heating the fresh water for continuing the cleaning process and/or for carrying out a rinsing process requires a huge amount of energy.

From DE 10 2013 002 116 A1, it is known to store water in a reservoir of a dishwasher for a predefined time period prior to the cleaning process, e.g. for several hours or overnight, such that the water inside the reservoir is preheated to the room temperature. In addition, the reservoir is positioned close to components of the dishwasher, which generate heat during operation, so that this heat may be absorbed by the water inside the reservoir.

In WO 2012/089569 A2, a household appliance for cleaning and drying goods is disclosed that includes a heat pump having a warm side including a condenser arranged in a water reservoir for heating the water therein, used in a cleaning process, and a cold side including an evaporator for condensing water vapour in a drying phase.

From EP 3 639 722 A1, it is known to arrange a heat exchanger in the form of a tube arranged inside the reservoir of the dishwasher, through which the greywater circulates for a time period, for exchanging heat with the fresh water in the reservoir.

In these known home appliances, the process of preheating or heating the water inside the reservoir using a heat exchanger or a condenser, which is arranged inside the reservoir, is time and energy consuming. Moreover, a heat pump unit is of complex design and requires a respective control amount.

SUMMARY

Thus, it is an object of the present invention to provide a home appliance and a method for controlling a home appliance, in which the energy consumption as well as the operation of the home appliance is optimized.

According to the present invention, there is provided a home appliance, in particular a dishwasher, a washing machine or the like. The home appliance comprises a water supply unit including a water supply port, for supplying water, like fresh water, to the home appliance, a water reservoir for storing water to be supplied to the home appliance by the water supply unit, a treatment space for treating objects in the home appliance, like dishes or laundry, at least one pump unit for circulating water inside the treatment space and for discharging water from the treatment space, like greywater, and a control unit for controlling the operation of the home appliance. In the inventive home appliance, a heat exchanger is arranged between the water supply unit and the water reservoir, for exchanging heat between the water supplied to the reservoir and the water discharged from the treatment space by the at least one pump unit.

This arrangement enables to heat the fresh water or drinking water to be heated immediately when being supplied to the reservoir, using the energy contained in the greywater being discharged from the home appliance. Thereby, an energy effective heating of fresh water is enabled and a delay of time for heating the fresh water in the reservoir or heating the fresh water shortly before reaching the reservoir is omitted, such that the operation of the home appliance may be optimized.

It has to be understood that the reservoir as well as the heat exchanger arranged upstream of the reservoir are sufficiently insulated to prevent heat losses during heat exchange and heat losses to the preheated water stored in the reservoir.

Generally, it is possible to use various kinds of heat exchangers for exchanging heat between the greywater supplied by the pump unit and the fresh water supplied to the reservoir. In order to maximize the amount of heat transferred from the greywater to the fresh water supplied to the reservoir, the heat exchanger is a counter flow heat exchanger. When using a counter flow heat exchanger, the fresh water supplied to the reservoir may be heated to a temperature approximately corresponding to the temperature of the greywater prior to the heat exchange process.

For further optimizing the process of heating the fresh water, the home appliance, and particularly the control unit of the home appliance, includes means for determining the time span or the flow rate for filling the water reservoir. Said time span or flow rate for filling the reservoir depends on various factors, like the pressure with which the fresh water is delivered by a public water supply or the size of the water supply valves and fittings. It has to be understood that one or more of these factors may be included into the determination of the span for filling the reservoir. This enables to adapt the period for filling the reservoir and the period of discharging the greywater to each other. In particular, it is possible to execute the filling of the reservoir and the discharge of the greywater at the same time. Thereby, the greywater needs to flow only one time through the heat exchanger for exchanging heat, a multiple circulation of the greywater through the heat exchanger is not necessary, and the process of exchanging heat is shortened.

In an advantageous embodiment of the inventive home appliance, the pump unit includes at least one of a drainage pump or at least one of a circulation pump, for supplying water from the treatment space to the heat exchanger. Said drainage pump as well as said circulation pump are controlled by the control unit, such that the operation of the drainage pump and/or the circulation pump may be adapted to the cleaning process as well as to the process of exchanging heat between the greywater and the fresh water.

In a further advantageous embodiment, the inventive home appliance includes means for adapting the flow rate of the water to be supplied to the reservoir and/or the water supplied from the treatment space to the heat exchanger. The means for adapting the flow rate may include one or more control valves, like throttle valves, that control the flow rate of the greywater supplied to the heat exchanger and/or the flow rate of the fresh water supplied to the reservoir. The operation of said control valves may be executed by the control unit, or said valves may be set depending on conditions at the installation site, like the local water pressure.

Alternatively or additionally, said means for adapting the flow rate of the water to be supplied to the reservoir and the water supplied from the treatment space to the heat exchanger may also be realized by the control unit, which controls the operation of the drainage pump and/or the circulation pump, e.g. by controlling (increasing or decreasing) their rotational speed.

The adaption of the flow rate of the water to be supplied to the reservoir and the water supplied from the treatment space to the heat exchanger may further optimize the heat exchanging process, since the heat transfer between two fluids also depends on their flow rate. Thereby, flow rates may be set, at which a maximal or an optimal transfer of heat may be realized.

It is further preferred that the heat exchanger includes at least one first flow channel for the water to be supplied to the reservoir and at least one second flow channel for the water supplied by the pump unit. However, for increasing or optimizing the surface of the heat exchanger, via which heat is exchanged between the greywater and the fresh water, the heat exchanger may include more than one first flow channel for the water to be supplied to the reservoir and/or more than one second flow channel for the water supplied by the pump unit.

For further optimizing the surface of the heat exchanger, via which heat is exchanged between the greywater and the fresh water, the first and second flow channels are arranged side by side. Thereby, contact surfaces or heat transfer surfaces between first and second flow channels are formed.

Alternatively, the second flow channel of the heat exchanger may be arranged inside the first flow channel, which thereby completely surrounds the second flow channel, whereby the heat transfer is further optimized. It is also possible to arrange the first flow channel inside the second flow channel. In such an arrangement, for preventing heat losses, it is preferred that greywater flows through the inner flow channel and fresh water flows through the outer flow channel. Accordingly, the heat transferred from the greywater is completely absorbed by the fresh water.

The heat exchanger may be made of any suitable heat conducting material. In a preferred embodiment, the first and second flow channels of the heat exchanger are made of a heat conducting material, like plastic material, particularly when said plastic material includes additives or when it is part of a compound material, stainless steel, copper or aluminium. These materials have very good heat conducting properties and are easy to process. In particular, plastic materials enable the design of complex structures for a heat exchanger. It has to be understood that also a combination of said heat conducting materials may be used.

According to the present invention, there is further provided a method for controlling a home appliance, in particular a dishwasher, a washing machine or the like. The home appliance comprises a water supply unit including a water supply port for supplying water, like fresh water or drinking water, to the home appliance, a water reservoir for storing water to be supplied to the home appliance by the water supply unit, a treatment space for treating objects in the home appliance, like dishes or laundry, at least one pump unit for circulating water inside the treatment space and for discharging water from the treatment space, like greywater, and a control unit for controlling the operation of the home appliance. The method comprises the steps of supplying water to the water reservoir by the water supply unit, supplying the water from the reservoir to the treatment space and circulating the water inside the treatment space and discharging the water from the treatment space by the at least one pump unit. The inventive method further comprises the step of feeding the greywater from the treatment space by the at least one pump unit to a heat exchanger arranged between the water supply unit and the water reservoir, for exchanging heat between the water supplied to the reservoir and the water discharged from the treatment space.

The inventive method further comprises the step of determining the time and/or the flow rate for filling the water reservoir. The determination of the filling time of the reservoir may be realized in various ways. Preferably, the flow of the water tap is metered by a respective flow meter.

Moreover, in the inventive method, the control unit controls the pump unit, for adapting the operation time of the pump unit to the time for filling the water reservoir.

In a preferred embodiment, the pump unit may be controlled by adjusting the rotational speed of the pump such that the operation time, i.e. the time for discharging a defined amount of greywater from the treatment space, corresponds to the time for filling the reservoir with a defined amount of fresh water.

Alternatively or additionally, the control unit controls the water supply unit, for adapting the time for filling the water reservoir to the operation time of the pump unit.

Further according to the inventive method, the flow rates of the water to be supplied to the reservoir and the water to be supplied from the treatment space to the heat exchanger may be adapted to each other.

The inventive method for operating a home appliance thereby provides all advantages explained in conjunction with the inventive home appliance.

Further advantages and preferred embodiments of the present invention will be described in the following together with the drawings listed below. The expressions "left", "right", "below" and "above" used in the following description refer to the drawings in an alignment such that the reference numbers and the notation of the figures used can be read in normal orientation.

DETAILED DESCRIPTION

Figure 1:
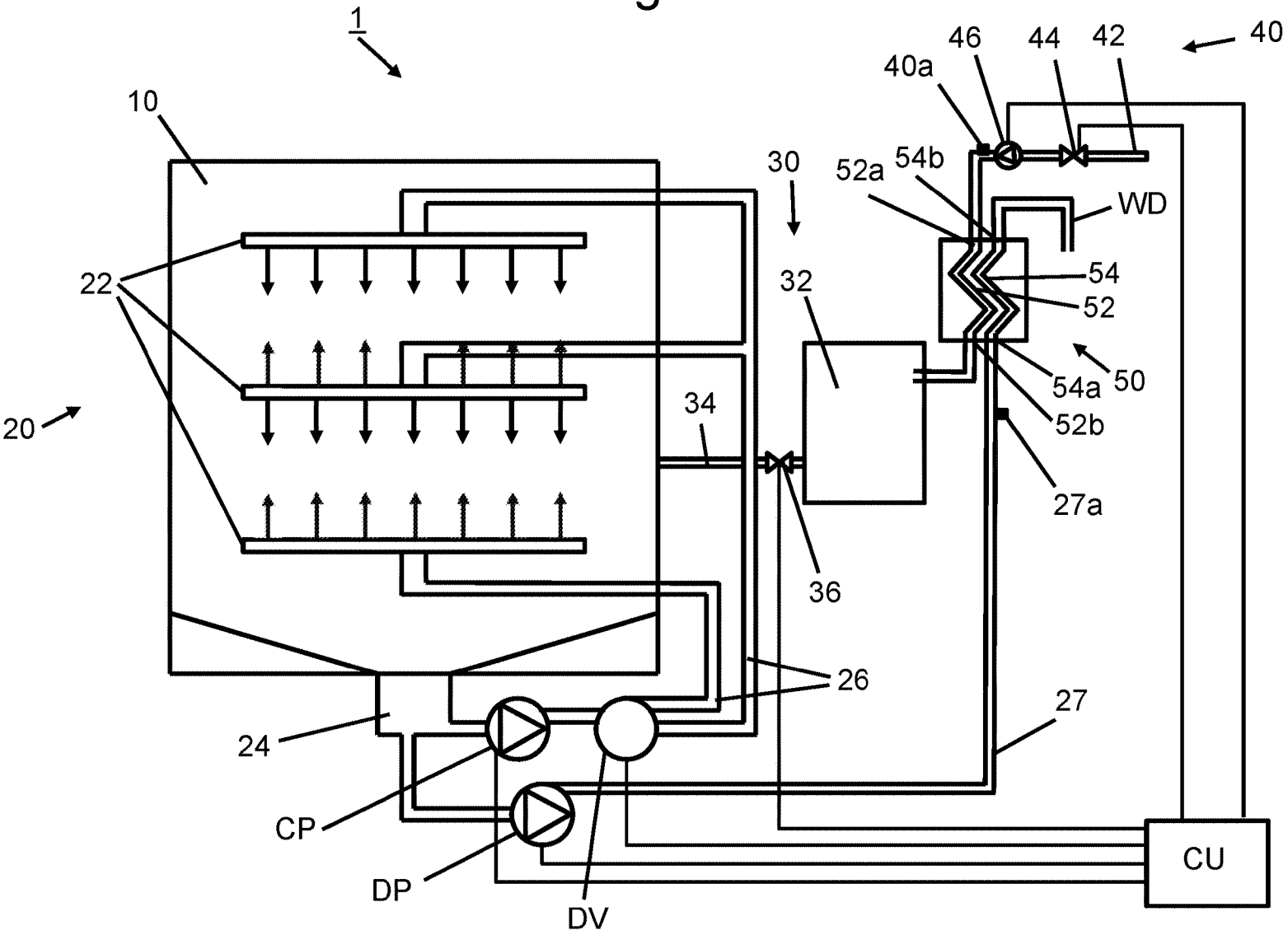
FIG. 1: is a schematic view of a first embodiment of a home appliance according to the present invention.

FIG. 1 schematically shows a first embodiment of a dishwasher 1 as a home appliance according to the present invention.

Dishwasher 1 comprises a treatment space 10, in which dishes to be cleaned may be placed. In treatment space 10, a spray arrangement 20 is accommodated, which includes spray arms 22, a sump 24 arranged in the bottom region of treatment space 10, a discharge pump DP coupled to sump 24, a circulation pump CP coupled to sump 24, a diverter DV arranged downstream of circulation pump CP and tubing 26 coupling diverter DV to spray arms 22 of spray unit 20. Diverter DV is realized in the form of a valve, which, in the embodiment according to FIG. 1, is a three-way-valve.

Dishwasher 1, shown schematically in FIG. 1, has three spray arms 22 arranged one above the other. All spray arms 22 are at least approximately horizontally oriented and include unspecified spray nozzles on their upper and, optionally, lower surfaces (in particular with spray arm 22 arranged between the upper and lower spray arms 22) for spraying water over the dishes to be cleaned. Spray arms 22 rotate about substantially vertically oriented unspecified axes, which also serve to supply the cleaning water to spray arms 22. Diverter DV is coupled by one tubing 26 to the lower most spray arm 22 and with a further tubing 26 to the middle and the upper most spray arm 22.

Dishwasher 1 further includes a reservoir 30 having a water storage 32 in which fresh water is stored. Reservoir 30 is coupled to treatment space 10 by a fluid connection 34 including a valve 36 and to a water supply unit 40. Fresh water is supplied to reservoir 30 via water supply unit 40. Water supply unit 40 may include a water supply port 42 and a valve 44, e.g. in the form of a check valve for preventing backflow of water to a public water supply, or a control valve for setting a predefined flow rate. As shown in FIG. 1, water supply unit 40, in this specific embodiment, may further include a supply pump 46 for supplying fresh water to reservoir 30, e.g. at a selected time point and/or with a selected pressure. Since the water pressure in the public water supply usually is high enough, a supply pump is not necessary. Alternatively, for controlling the flow of fresh water to dishwasher 1, a flow control valve may be provided in water supply unit 40.

As further can be seen in FIG. 1, between reservoir 30 and water supply unit 40, a heat exchanger 50 is arranged. Heat exchanger 50, which is preferably a counter flow heat exchanger, has a first flow path 52 having an inflow end 52*a* as well as an outflow end 52*b*, and a second flow path 54 having an inflow end 54*a* as well as an outflow end 54*b*. Inflow end 52*a* of first flow path 52 is coupled to water supply unit 40 and outflow end 52*b* terminates in water storage 32 of reservoir 30, such that fresh water entering heat exchanger 50 flows through first flow path 52 into water storage 32 of reservoir 30. Inflow end 54*a* of second flow path 54 is coupled via a tubing 27 to drain pump DP. Outflow end 54*b* of second flow path 54 is coupled to a water drain WD such that greywater discharged from sump 24 by drain pump DP flows through second flow path 54 and to water drain WD.

Moreover, a control unit CU is provided, for controlling the operation of dishwasher 1. As can be seen in FIG. 1, control unit CU is coupled via respective control wires to drain pump DP, circulation pump CP, diverter DV, valve 36 of fluid connection 34, valve 44 and supply pump 46 of water supply unit 40.

It has to be understood that control unit CU may also include all necessary programming for executing various cleaning operations according to a selected cleaning program. Alternatively, control unit CU may be a sub-control unit coupled to a primary control unit.

In operation of dishwasher 1 according to the first embodiment of FIG. 1, with treatment space 10 loaded with dishes to be cleaned, and in particular, after a first cleaning step or rinsing step has been executed, in which fresh water supplied to treatment space 10 has been heated up, greywater is present in treatment space 10 or sump 24, respectively. Said greywater has a temperature that at least approximately corresponds to the temperature of the heated fresh water. For executing a subsequent cleaning step or rinsing step, control unit CU opens valve 44 and activates supply pump 46 for supplying a predefined amount of fresh water to water storage 32 of reservoir 30. At the same time, control unit CU activates drain pump DP, such that greywater is discharged from treatment space 10 or sump 24, respectively. Accordingly, fresh water flowing through first flow path 52 of heat exchanger 50 and greywater flowing through second flow path 54 of heat exchanger 50 exchange heat.

Due to the fact that heat exchanger 50 is a counter flow heat exchanger, flow paths 52, 54 are arranged close to each other, with inflow end 52*a* of first flow path 52 being arranged side by side with outflow end 54*b* of second flow path 54 and outflow end 52*b* of first flow path 52 arranged side by side with inflow end 54*a* of second flow path 54, heat from greywater can efficiently be transferred to the fresh water, such that the fresh water entering reservoir 30 may be heated up at least approximately to the temperature of the greywater when discharged from treatment space 10.

For executing a selected cleaning program, control unit CU opens valve 36 of fluid connection 34, such that warm fresh water from reservoir 30 may enter treatment space 10 of dishwasher 1. The warm fresh water may pass a compartment (not shown), in which a cleaning agent is provided to be added to the water supplied to the treatment space. After a predefined amount of fresh warm water has been supplied to treatment space 10, valve 36 is closed. Thereafter, control unit CU activates circulation pump CP and diverter DV in accordance with the selected cleaning program, for circulating the water inside treatment space 10.

A rinsing or flushing procedure may be an intermediate step and/or the final step of a cleaning program. For executing a rinsing procedure, valve 44, supply pump 46 and drain pump DP are activated by control unit CU, such that fresh water flowing through heat exchanger 50 into reservoir 30 may be heated up by greywater discharged by drain pump DP from treatment space 10, as explained in conjunction with the cleaning procedure above. After a predetermined amount of fresh water is heated and stored in reservoir 30, valve 44, supply pump 46 and drain pump DP are deactivated, valve 36 of fluid connection 34 is opened for supplying warm fresh water to treatment space 10, valve 36 is closed and the rinsing procedure may be started by operating circulation pump CP.

During a cleaning procedure as well as a rinsing procedure, the amount of water supplied by circulation pump CP to spray arms 22 of spray unit 20 may be adjusted such that each spray arm 22 is provided with a predefined amount of water to be sprayed onto the items to be cleaned or rinsed.

After the rinsing procedure, the warm greywater in treatment space 10 may again be used to heat fresh water supplied by water supply 40 to reservoir 30.

As explained above, heat exchanger 50 is a counter flow heat exchanger. That means, heat is exchanged between the greywater and the fresh water while both, the greywater and the fresh water flowing through first and second flow paths 52, 54 of heat exchanger 50.

For an optimized heat transfer, which means that the highest possible amount of heat is transferred from the greywater to the fresh water, the flow of greywater and the flow of fresh water through heat exchanger 50 should start at the same time, and should also end at the same time.

Accordingly, the flow rate of greywater and the flow rate of fresh water may be controlled such that in the time span, the amount of greywater discharged from treatment space 10 or sump 24 by discharge pump DP needs to pass heat exchanger 50, also the amount of fresh water to be supplied to reservoir 30 passes heat exchanger 50. For determining the flow rate of the greywater and the fresh water, a respective sensor 27*a* may be provided, e.g. in tubing 27 for determining the flowrate of the greywater, and a respective sensor 40*a* may be provided in water supply unit 40 for determining the flowrate of the fresh water. Said sensor may e.g. be a flow meter. However, since the conditions in the hydraulic system for treating the greywater are known, a separate flow meter, like sensor 27*a*, is not necessary. The flow rate or volume flow of greywater may controlled by adjusting the rotational speed of discharge pump DP.

For adapting the time span the amount of greywater needs to pass heat exchanger 50, control unit CU may control drain pump DP, e.g. by increasing the rotational speed of drain pump DP to shorten the time span necessary for the amount of greywater to pass heat exchanger 50, or by decreasing the rotational speed of drain pump DP, to lengthen said time span.

Alternatively or additionally, control unit CU may also adapt the time span the amount of fresh water needs to pass heat exchanger 50. Depending on the water pressure in the public water supply, control unit CU may adjust the opening degree of valve 44 of water supply unit 40 to shorten or to lengthen the time span the amount of fresh water needs to pass heat exchanger 50. Furthermore, control unit CU may also control supply pump 46 by increasing or decreasing the rotational speed of supply pump 46.

It has to be understood that control unit CU may control one of valve 44 or supply pump 46, or both, for adapting the time span the amount of fresh water needs to pass heat exchanger 50.

It has further to be understood that control unit CU, for adapting the flow rate of greywater and the flow rate of fresh water, may control the flow rate of one or both of the greywater or the fresh water.

The amount of greywater to be discharged from sump 24 by drain pump DP as well as the amount of fresh water to be supplied to reservoir 30 may vary, e.g. depending on the selected cleaning program. Accordingly, for determining the amount of fresh water to be supplied to reservoir 30, control unit CU may use data stored in control unit CU, like date concerning various cleaning programs, for adapting the flow rate of the greywater and/or the fresh water, accordingly.

Figure 2:
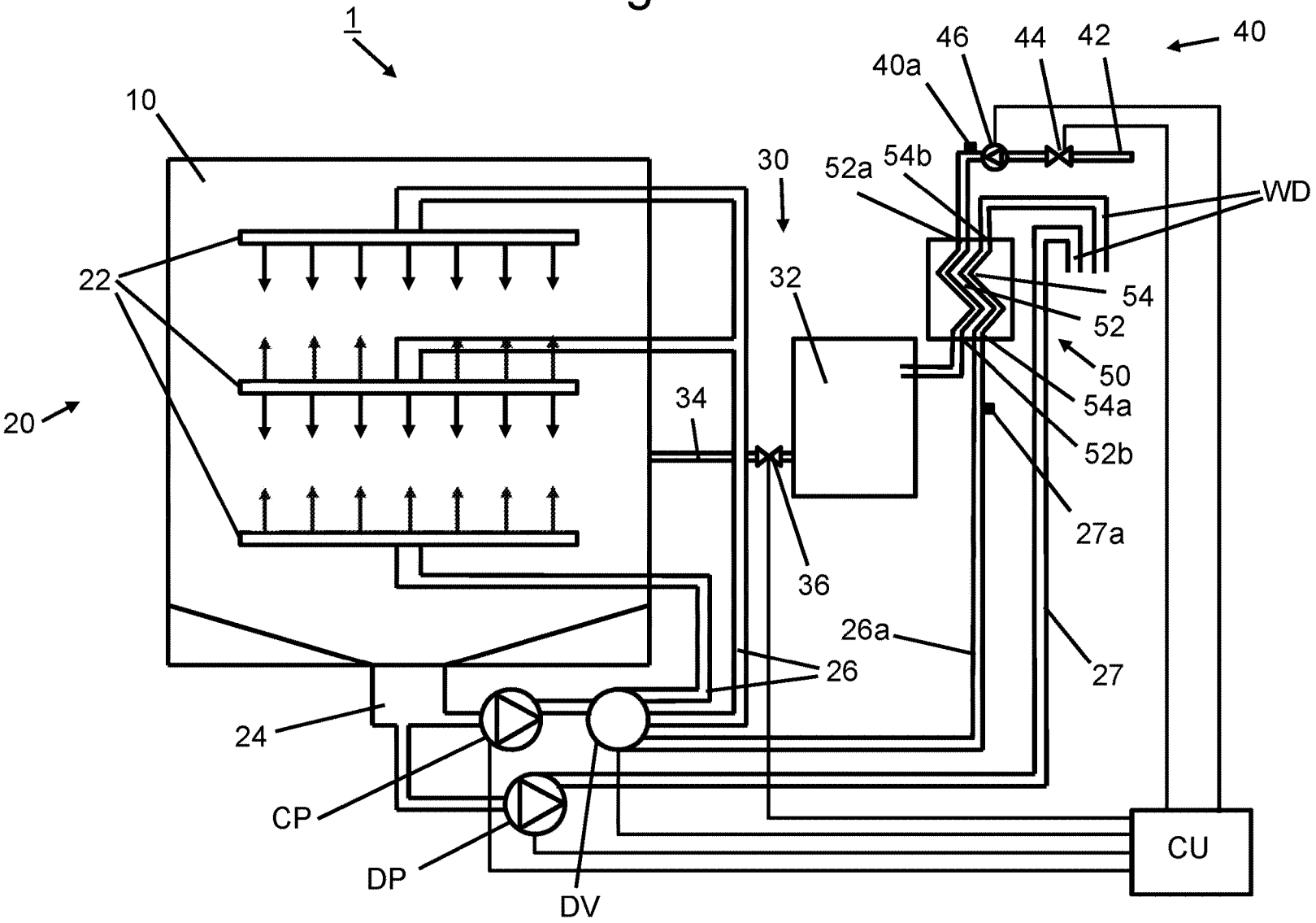
FIG. 2: is a schematic view of a second embodiment of a home appliance according to the present invention.

FIG. 2 schematically shows a second embodiment of a dishwasher 1 as a home appliance according to the present invention.

Dishwasher 1 according to FIG. 2 is of similar design as that shown in FIG. 1. Thus, physically or functionally identical elements, units or assemblies are provided with identical reference signs.

The second embodiment of dishwasher 1 of FIG. 2 differs from the first embodiment shown in FIG. 1 in that inflow end 54*a* of second flow path 54 is coupled by a tubing 26*a* to circulation pump CP via diverter DV. Outflow end 54*b* of second flow path 54 is coupled to a water drain WD. Accordingly, greywater that is discharged by circulation pump CP from sump 24, and which is guided by diverter DV into tubing 26*a* flows through second flow path 54 and to water drain WD. In this embodiment, diverter DV is a four-way-valve.

Further in contrast to the first embodiment of dishwasher 1 of FIG. 1, in the second embodiment of dishwasher 1, discharge pump DP is directly coupled via tubing 27 to water drain WD, such that greywater discharged from sump 24 by discharge pump DP directly flows to water drain WD without entering heat exchanger 50.

The operation of dishwasher 1 according to the second embodiment shown in FIG. 2 is similar to that of dishwasher 1 of FIG. 1.

During a cleaning operation of dishwasher 1, and in particular after a first cleaning step or rinsing step has been executed, in which fresh water supplied to treatment space 10 has been heated up, such that warm greywater is present in treatment space 10 or sump 24, control unit CU opens valve 44 and activates supply pump 46 such that a predefined amount of fresh water is supplied to water storage 32 of reservoir 30. Control unit CU activates circulation pump CP and opens a fluid connection between diverter DV and inflow end 54*a* of second flow path 54 of heat exchanger 50 via tubing 26*a*, such that warm greywater is discharged by circulation pump CP from treatment space 10 or sump 24, respectively. Accordingly, fresh water flowing through first flow path 52 of heat exchanger 50 and greywater flowing through second flow path 54 of heat exchanger 50, exchange heat, whereby the fresh water is heated up.

For executing a selected cleaning program, control unit CU opens valve 36 of fluid connection 34, such that warm fresh water from reservoir 30 may enter treatment space 10 of dishwasher 1. After a predefined amount of warm fresh water has been supplied to treatment space 10, valve 36 is closed. Thereafter, control unit CU activates circulation pump CP and diverter DV in accordance with the selected cleaning program, for circulating the water inside treatment space 10. Diverter DV is adjusted such that greywater fed by circulation pump CP is supplied via tubing 26 to spray arms 22.

For executing a rinsing procedure, valve 44, supply pump 46 and drain pump DP are activated by control unit CU, such that fresh water flows through heat exchanger 50 into reservoir 30. Furthermore, circulation pump CP is activated and diverter DV is adjusted such that greywater is supplied by circulation pump CP via diverter DV and tubing 26*a* to heat exchanger 50, where heat is exchanged between the greywater delivered to reservoir 30 by circulation pump CP and fresh water supplied by water supply unit 40.

After a predetermined amount of fresh water is heated and stored in reservoir 30, valve 44, supply pump 46 and drain pump DP are deactivated, valve 36 of fluid connection 34 is opened for supplying warm fresh water to treatment space 10, valve 36 is closed and the rinsing procedure may be started by activating circulation pump CP.

Also in dishwasher 1 according to the second embodiment, the warm greywater in treatment space 10 used in the rinsing procedure, may again be used to heat fresh water supplied by water supply 40 to reservoir 30.

In the second embodiment of dishwasher 1, drain pump DP is connected to water drain WD, such that greywater may directly be discharged from treatment space 10 or sump 24 without being fed through heat exchanger 50, e.g. for executing repair or maintenance of dishwasher 1.

In the embodiments of dishwasher 1 according to FIGS. 1 and 2, diverter DV, controlled by control unit CU, completely or partially opens or closes connections to tubing 26, for enabling the flow of a predefined amount of water to spray arms 22. Diverter DV may include respective valves forming said connections to tubing 26, and that may be opened or closed accordingly.

Alternatively, diverter DV may also be controlled independently from control unit CU, at least partially, e.g. via a timer that is activated by starting home appliance 1, or a cleaning program, respectively.

Furthermore, diverter DV may be provided with one or more defined settings regarding the opening degree of the connections or valves to tubing 26, with each setting corresponding to a predefined amount of water to be supplied to spray arms 22. Said one or more settings may be selected in accordance with a specific cleaning program executed by dishwasher 1.

Usually, when starting dishwasher 1, e.g. at the beginning of a cleaning operation or after repair or maintenance, there is no greywater in treatment space 10 or sump 24. Accordingly, at the beginning of a cleaning operation, fresh water delivered to reservoir 30 may not be heated by heat exchanger 50. For heating fresh water delivered to reservoir 30 at the beginning of a cleaning operation, dishwasher 1 may include a heating device. Said heating device, which may be an electric heater, may be arranged at any suitable position, e.g. inside reservoir 30, for directly heating the water therein, or at an outer surface of reservoir 30, for transferring heat via said outer surface to the water inside reservoir 30.

Said heating device may also be used for further heating the fresh water inside reservoir 30 in the case that said fresh water has not reached a predefined temperature during heating in heat exchanger 50. For determining the temperature of the fresh water in reservoir 30, a temperature detection sensor (not shown) may be provided which is coupled to control unit CU, such that also the operation of said heating device may be controlled by control unit CU.

Alternatively or additionally to the a heating device for heating fresh water supplied to reservoir 30, dishwasher 1 may be provided with a warm water supply unit, which is similar to water supply unit 40, and which may be connected to a warm water tap present at the installation location of dishwasher 1. Accordingly, when starting dishwasher 1 and no warm greywater is available in treatment room 10 or sump 24, dishwasher 1 may be controlled such that a predefined amount of warm fresh water is supplied to reservoir 1 from the warm water tab via said warm water supply unit.

Figure 3:
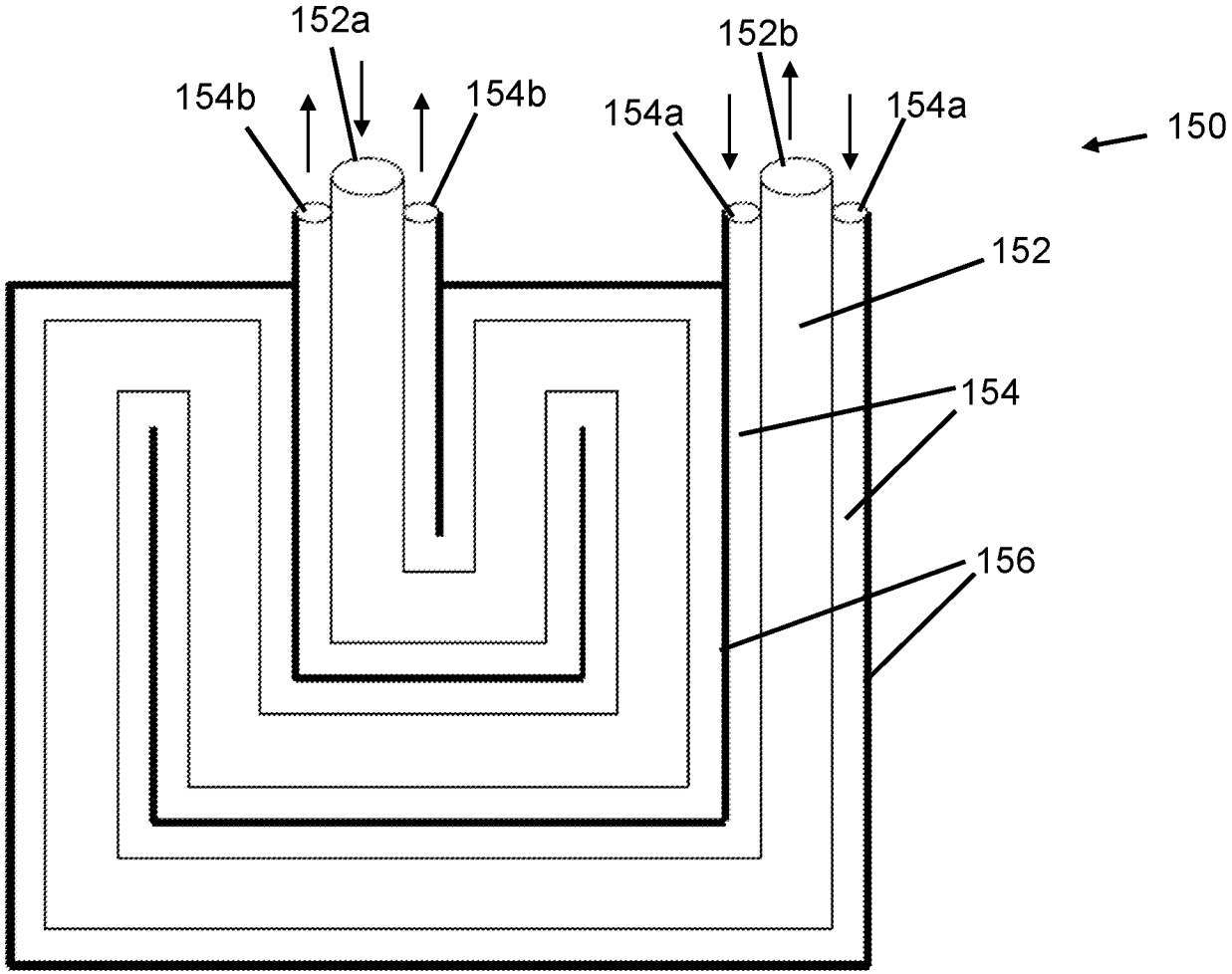
FIG. 3: is a schematic view of a heat exchanger for use in a home appliance according to the present invention.

FIG. 3 is a schematic view of a heat exchanger 150 for use in a dishwasher 1 according to the present invention.

Heat exchanger 150 includes a first flow channel 152 having an inflow end 152*a* and an outflow end 152*b*, and two second flow channels 154 having inflow ends 154*a* and outflow ends 154*b*. Second flow channels 154 are arranged at opposite sides of first flow channel 152 and contact one another. First and second flow channels 152, 154 are arranged meandering such that heat exchanger 150 has a compact design. Moreover, for preventing heat loss to the ambiance, and for optimizing heat transfer between the fluids in first flow channel 152 and second flow channels 154, first flow channel 152 and second flow channels 154 arranged adjacent first flow channel 152 are thermally insulated by a respective insolation layer 156 against other portions of first and second flow channels 152, 154 meandering along each other as well as at the outer circumferential surfaces of heat exchanger 150.

Heat exchanger 150 is preferably a counter flow heat exchanger. That means outflow ends 154*b* of second flow channels 154 are arranged close to inflow end 152*a* of first flow channel 152, and inflow ends 154*a* of second flow channels 154 are arranged close to outflow end 152*b* of first flow channel 152, and fluids in first and second flow channels 152, 154 flow in opposite directions along each other.

Flow channels 152, 154 of heat exchanger 150 are arranged at least approximately in a plane, such that heat exchanger 150 is of a substantially flat configuration.

In heat exchanger 150, first flow channel 152 guides greywater through heat exchanger 150, and fresh water is guided through heat exchanger 150 via second flow channels 154.

FIGS. 4*a* to 4*d* are schematic cross sectional views of first and second flow channels 252, 254 of heat exchangers 250 for use in a dishwasher 1 according to the present invention.

Figure 4A:
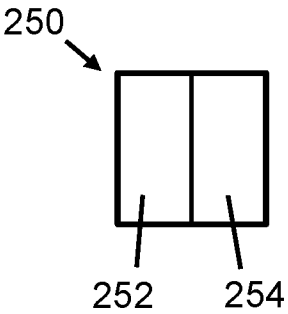
FIGS. 4*a* to 4*d*: are schematic cross-sectional views of heat exchangers for use in a home appliance according to the present invention.

According to FIG. 4*a*, a first flow channel 252 and a second flow channel 254 are provided, each having a rectangular cross section. First and second flow channels 252, 254 are arranged side by side such that one of their longitudinal sides adjoins the other, thereby forming the heat transfer surface between first and second flow channels 252, 254.

Figure 4B:
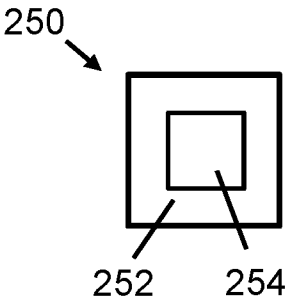

According to the embodiment of FIG. 4*b*, first and second flow channels 252, 254 are square shaped with first flow channel 252 having a larger cross sectional dimension than second flow channel 254. Furthermore, second flow channel 254 is arranged approximately centrally inside first flow channel 252, such that the outer surface of second flow channel 254 forms the heat transfer surface between first and second flow channels 252, 254. Further according to FIG. 4*b*, the effective cross-sectional areas of first and second flow channels 252, 254, through which fresh water and greywater flows, are of different size. However, these areas may also be selected to be of identical size.

Figure 4C:
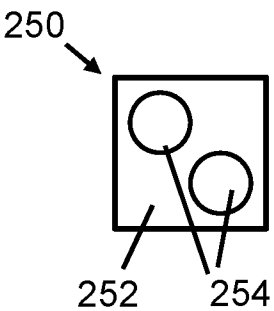

First flow channel 252 according to the embodiment of FIG. 4*c* is square shaped. Two second flow channels 254 are provided that have circular cross sections of approximately the same size, and are arranged inside first flow channel 252. The outer surfaces of second flow channels 254 form the heat transfer surface between first and second flow channels 252, 254.

Figure 4D:
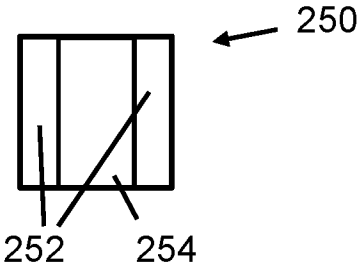

According to FIG. 4*d*, first flow channel 252 has a square shape, whereas second flow channel 254 has a rectangular cross section with longitudinal sides that have a length corresponding to the length of the sides of square shaped first flow channel 252. Second flow channel 254 is arranged approximately centrally inside first flow channel 252 such that heat may be transferred between the fluids in the first and second flow channels 252, 254 via the longitudinal sides of second flow channel 254.

Figure 4E:
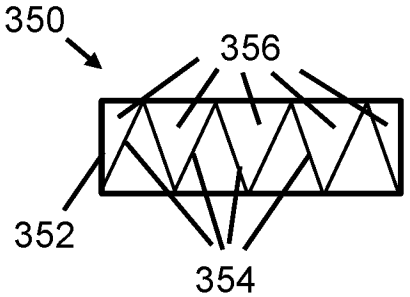
FIGS. 4*e* and 4*f*: are schematic cross-sectional views of further embodiments of heat exchangers for use in a home appliance according to the present invention.
Figure 4F:
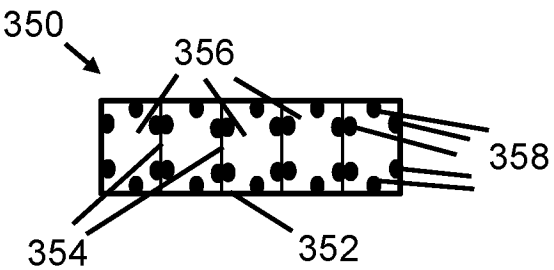

FIGS. 4*e* and 4*f* show embodiments of tubes for use in a heat exchanger 350. Said tubes are formed as so-called microchannel tubes. That means said tubes include an outer tube 352 having a substantially flat cross section. Inside said flat tube 352, structures 354 are arranged for forming several channels 356 between flat tube 352 and elements of structures 354.

In the embodiment of FIG. 4*e*, structure 354 includes flat elements in a zig-zag configuration, such that channels 356 formed inside flat channel 354 have triangular cross sections with the flat elements of structure 356 forming the heat transfer surfaces.

According to FIG. 4*f*, flat tube 352 has a rectangular cross section. In flat tube 352, several flat elements as structure 354 are arranged vertically and in approximately regular intervals. Between the short sides of flat tube 352 and neighboring flat elements of structure 354, channels 356 are formed, such that the flat elements of structure 354 for the heat transfer surfaces are arranged between two neighboring channels 356.

Additionally, protrusions 358 may be arranged on the inner surfaces of channels 356, for increasing the inner surface of channels 356, for enhancing the heat transfer between the fluids in two neighboring channels.

For adapting the size of the heat exchanger to the amount of heat provided by the greywater and/or the amount of heat to be recovered from the greywater, it is possible to select first and second flow channels, which have respective cross sectional profiles with respective cross sectional dimensions. Alternatively or additionally, the length of the first and second flow channels may be selected to match the desired heat transfer capacity of the heat exchanger.

It has to be understood that flow channels 252, 254 and flat tubes 352 according to FIGS. 4*a* to 4*f* may be provided with a respective thermal insulation at their outside for preventing heat losses to the ambiance.

Figure 5:
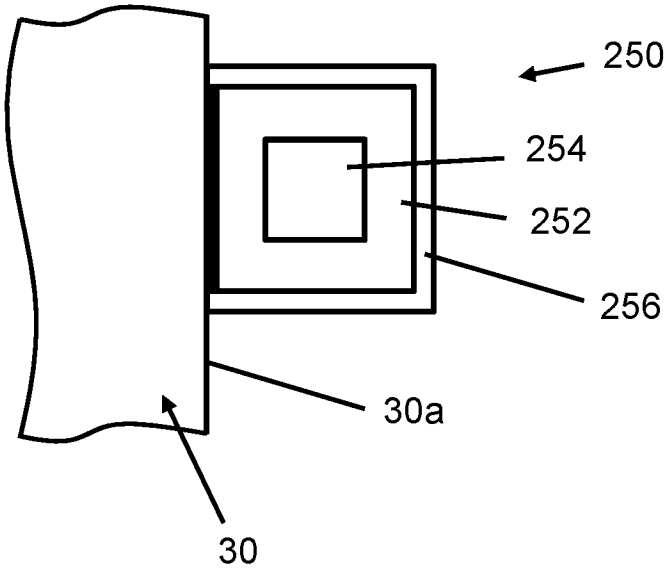
FIG. 5: is a schematic cross-sectional view of a heat exchanger in a specific arrangement in the home appliance according to the present invention.

FIG. 5 is a schematic cross-sectional view of heat exchanger 250 according to FIG. 4*b*, as one example of a heat exchanger according to the present invention, in a specific arrangement in dishwasher 1.

Heat exchanger 250 is provided with an insulating layer 256. Moreover, heat exchanger 250 is arranged close to a side wall 30*a* of reservoir 30. Thereby, a heat transfer is enabled between heat exchanger 250 and reservoir 30, in order to reduce possible heat loss to the ambiance. It has to be noted that heat exchanger 250 may also be partially or completely arranged inside reservoir 30, such that approximately any possible heat loss via the outer surface of heat exchanger 250 to the ambiance may be prevented.

In conjunction with FIG. 3, it has been mentioned that in heat exchanger 150, first flow channel 152 guides greywater through heat exchanger 150, and fresh water is guided through heat exchanger 150 via second flow channels 154. However, it is also possible that greywater is guided through second flow channels 154 and fresh water flows through first flow channel 152, accordingly.

Furthermore, in the embodiments of flow channels 252, 254 according to FIGS. 4*b* to 4*e*, the outer first channels 252 are preferably used for guiding fresh water and inner second channels 254 guide greywater through heat exchanger 252, respectively. Also in these embodiments, it is possible that greywater flows through outer first channels 252 and fresh water flows through inner second channels 254 for exchanging heat between each other.

According to the embodiments of dishwasher 1 shown in FIGS. 1 and 2, water supply unit 40 includes a supply pump 46 for controlling the flow rate of water supplied to reservoir 30 by adjusting the rotational speed of supply pump 46. However, in the case that fresh water is provided by the public water supply with sufficient pressure, an additional supply pump is not necessary. In order to adapt the pressure of the water in the public water supply to a selected pressure, a flow control valve may be provided in water supply unit 40.

As described in conjunction with FIGS. 1 and 2, dishwasher 1 includes a reservoir 30 into which fresh water is filled and heated up at the same time, by greywater being discharged from treatment space 10 of dishwasher 1.

For realizing the inventive idea in a washing machine as a further kind of a home appliance, also said washing machine needs to be provided with a separate space that corresponds to reservoir 30, into which a predefined amount of fresh water is supplied while being heated by greywater discharged from the washing machine at the same time.

A home appliance according to the present invention has been described as being a dishwasher or a washing machine. However, the general idea of the present invention, to control the flow of heated water used in a home appliance, so called greywater, and the flow of fresh water supplied to said home appliance, for optimizing heat exchange between said greywater and said fresh water for saving energy, may be executed in other machines from which heated greywater is discharged and to which fresh water that has to be heated is supplied.

The invention claimed is:

1. A home appliance comprising:

a water supply unit including a water supply port, configured to be connected to a water supply, for supplying water to the home appliance;

a water reservoir for storing water to be supplied to the home appliance by the water supply unit;

a treatment space for treating objects in the home appliance;

at least one pump unit for circulating water inside the treatment space and for discharging water from the treatment space;

a control unit for controlling the operation of the home appliance;

a heat exchanger arranged between the water supply unit and the water reservoir, for exchanging heat between the water supplied to the reservoir and the water discharged from the treatment space by the at least one pump unit; and a flow meter for determining the flow rate of the water supplied by a water tap to the reservoir;

wherein the control unit controls the pump unit for adapting the operation time of the pump unit to the flow rate for filling the water reservoir.

2. The home appliance according to claim 1, wherein the heat exchanger is a counter flow heat exchanger.

3. The home appliance according to claim 1, wherein the pump unit includes at least one of a drainage pump or a circulation pump, for supplying water from the treatment space to the heat exchanger.

4. The home appliance according to claim 1, further including means for adapting the flow rate of the water to be supplied to the reservoir and the water supplied from the treatment space to the heat exchanger.

5. The home appliance according to claim 1, wherein the heat exchanger includes at least one first flow channel for the water to be supplied to the reservoir and at least one second flow channel for the water supplied by the pump unit.

6. The home appliance according to claim 5, wherein the first and second flow channels are arranged side by side.

7. The home appliance according to claim 5, wherein the second flow channel is arranged inside the first flow channel.

8. The home appliance according to claim 5, wherein the first and second flow channels of the heat exchanger are made of a heat conducting material.

9. A method for controlling a home appliance, the home appliance comprising a water supply unit including a water supply port configured to be connected to a water supply, for supplying water, like fresh water to the home appliance, a water reservoir for storing water to be supplied to the home appliance by the water supply unit, a treatment space for treating objects in the home appliance, at least one pump unit for circulating water inside the treatment space and for discharging water from the treatment space, and a control unit for controlling the operation of the home appliance, the method comprising the steps of:

supplying water to the water reservoir by the water supply unit;

supplying the water from the reservoir to the treatment space;

circulating the water inside the treatment space and discharging the water from the treatment space by the at least one pump unit;

feeding the water from the treatment space by the at least one pump unit to a heat exchanger arranged between the water supply unit and the water reservoir, for exchanging heat between the water supplied to the reservoir and the water discharged from the treatment space;

determining by a flow meter the flow rate of the water supplied by a water tap to the reservoir; and adapting by the control unit the operation time of the pump unit to the flow rate for filling the water reservoir.

10. The method according to claim 9, wherein the control unit controls the water supply unit, for adapting the time or the flow rate for filling the water reservoir to the operation time of the pump unit.

11. The method according to claim 9, wherein the pump unit is controlled by adjusting a rotational speed of said pump unit.

12. The method according to claim 9, further including the step of adapting the flow rate of the water to be supplied to the reservoir and the water supplied from the treatment space to the heat exchanger to each other.

* * * * *